US005573075A

United States Patent [19]

Henry et al.

[11] Patent Number: 5,573,075

[45] Date of Patent: Nov. 12, 1996

[54] PNEUMATIC IMPACT TOOL HAVING IMPROVED VIBRATION AND NOISE ATTENUATION

[75] Inventors: Edgar G. Henry, Kirtland; Frank W. Schossler, Willoughby Hills; Donald K. Kuhl, Chesterland, all of Ohio

[73] Assignee: T.C. Service Company, Highland Heights, Ohio

[21] Appl. No.: 498,369

[22] Filed: Jul. 5, 1995

[51] Int. Cl.[6] ..... B25D 17/11

[52] U.S. Cl. ..... 173/211; 173/162.1

[58] Field of Search ..... 173/137, 162.1, 173/162.2, 206, 210, 211, 212

[56] References Cited

U.S. PATENT DOCUMENTS

| | | | |
|---|---|---|---|
| 1,220,100 | 3/1917 | Haeseler | 173/210 X |
| 1,896,992 | 2/1933 | Agren | 173/211 X |
| 3,456,744 | 7/1969 | Altschuler | 173/212 X |
| 4,310,055 | 1/1982 | Wanner et al. | 173/212 X |
| 4,402,369 | 9/1983 | Nikitin et al. | 173/162.1 X |
| 4,681,172 | 7/1987 | Mikiya et al. | 173/162.1 X |
| 4,723,610 | 2/1988 | Dummermuth et al. | 173/162.1 X |
| 5,117,923 | 6/1992 | Wuhrer | 173/210 X |
| 5,407,018 | 4/1995 | Henry | 173/211 |
| 5,417,294 | 5/1995 | Suher | 173/211 X |

*Primary Examiner*—Scott A. Smith
*Assistant Examiner*—Jay A. Stelacone
*Attorney, Agent, or Firm*—John F. McDevitt

[57] ABSTRACT

Vibration and noise are considerably reduced in a pneumatic impact tool with structure providing novel vibration dampening and vibration isolation. The required vibration reducing components employ particular vibration dampening chamber members which dynamically interact with further included multi-part spring and elastomeric members.

15 Claims, 2 Drawing Sheets

PNEUMATIC IMPACT TOOL HAVING IMPROVED VIBRATION AND NOISE ATTENUATION

BACKGROUND OF THE INVENTION

This invention relates generally to a hand-operated pneumatic power tool having improved means for attenuation of both vibration and noise when being operated and more particularly to the construction of such type tool device which employs a reciprocating work member such as a chisel, hammer or the like.

Various means are already known to nullify or reduce considerable impact otherwise experienced by operators of pneumatic power tools, both hand-held and hand-operated, to include chippers, hammers, tampers, jack hammers and the like. In addition to requiring considerable strength to operate such tools, the continuous comparatively large amplitude impacting mechanical forces associated with the recoil reaction of the reciprocating work member often results in serious physical harm to the tool operator. Thus, there has long been a need for vibration attenuation in such pneumatic powered impact tools so that little if any cyclical impact forces will be transmitted to the tool operator. Likewise, various federal and state governmental agencies are becoming increasingly concerned with the serious need to reduce noise in the work place based on either health considerations for the work force or disturbance to the surrounding population.

Pneumatic dampening of the reciprocating work member has been employed as a known means to secure vibration attenuation for a variety of such impact tools. For example, such pneumatic attenuation means are disclosed in U.S. Pat. No. 3,456,744 whereby the recoil of a free piston member in such type device is dampened with a pneumatic counter-force. As therein described at the time the piston starts backward movement there is gas pressure between the forward face of the piston and the tool member tending to drive the piston backward. The volume between the rear of the piston and the closed end of a movable sleeve member is vented to the atmosphere. As the piston moves backward the movable sleeve member moves forward under gas pressure in a peripherally located chamber between said sleeve member and a further tool member in the device and between the forward face of the piston and the sleeve member. As the sleeve member moves forward, the passage is closed thereby trapping gas between the rear face of the piston and the closed end of the sleeve member. Also, the volume between the piston and tool bit is closed thereby retaining the gas therein which expands as the piston moves to the rear. Compression of the gas in the volume between the rear face of the piston and the closed end of the sleeve member tends to decelerate both the piston and the sleeve member without imparting cyclic recoil forces to the tool member, barrel member or the handle in said device. A similar vibration dampening mechanism is described in U.S. Pat. No. 4,398,411 wherein the vibration and recoil otherwise experienced during operation of a rivet bucking tool is absorbed in the tool housing with compressed air being introduced into a dampening chamber. The pressure of the reduced air from an outside source is made adjustable with valve means while a further O-ring element in this tool construction is also reported to resiliently dampen forward impact by the reciprocating piston.

Still other type deformable attenuation means have been utilized in pneumatic impact tools to minimize vibration, including employment of elastomeric buffers and mechanical springs. For example, a hand-held pneumatic powered tool of this type is disclosed in U.S. Pat. No. 5,054,562 which is constructed of rigid parts isolated from each other by elastomeric shock-absorbing material arranged between the parts in laminar fashion in which certain of the layers are of a different Shore A hardness as respect each other. The layers are reported to be formed with different thicknesses which are introduced into an annular space between the parts in pourable condition, each layer being permitted to set-up before the next layer is poured, which results in bonding of the elastomeric layers to each other as well as to the parts. A novel supporting structure is reported to be disposed between the parts to space them in condition to receive the elastomeric material and the structure is permitted to remain between the parts in such isolated or shock-absorbing fashion so as to improve the vibration-minimizing characteristics of the overall construction. Elastomers reported to be useful for such device construction are any of the known liquid polyurethane types pourable at room temperature or up to about 100° F. and with decreasing Shore A hardness being exhibited in successive layers of the poured elastomer. In U.S. Pat. No. 5,407,018 there is also disclosed elastomeric attenuation means having a novel multi-part construction for impact tools to provide a still greater degree of vibration and noise attenuation. A still different vibration and noise attenuation construction impact tools which employs oppositely biased metal springs is similarly disclosed in U.S. Pat. No. 4,351,225.

In co-pending U.S. patent application Ser. No. 08/498,370 filed Jul. 5, 1995 in the names of the present inventors and filed concurrently with the present application, there is disclosed improved means for attenuation of both vibration and noise for a hand-operated pneumatic impact tool having a multi-part construction. As therein disclosed, pneumatic dampening chamber means in the tool undergo compression when the reciprocating work member recoils as a means for such attenuation in dynamic cooperation with further included resilient seal means. In general, the construction of the tool device operating in such improved manner includes a housing member having a central passageway, a closed end hollow sleeve member slidably engaged in the central passageway of said housing member which includes a free piston member movably disposed therein, a reciprocating impact member closing the front end of said sleeve member for cyclical engagement with said free piston member, a pneumatic valve mechanism closing the back end of said sleeve member for exerting pressurized fluid against the opposite ends of said free piston member, the back end of the central passageway in said housing member providing a pneumatic vibration dampening chamber which is compressed by rearward movement of said sleeve member and resilient seal means disposed at the back end of said sleeve member for cooperation with said vibration dampening means. Since the present invention represents a still further improvement which includes such attenuation means, the entire contents of said co-pending Ser. No. 08/498,370 application are hereby specifically incorporated by reference into the present application.

It is an object of the present invention, therefore, to provide still further improved means for vibration and noise attenuation in a pneumatic impact tool requiring only a relatively simple modification of the existing tool construction.

A still further object of the present invention is to provide the desired improvement in a distinctive manner involving cooperation between component parts of a multi-part attenuation means.

It is yet another object of the present invention to provide the desired improvement in a variety of pneumatic powered impact tools including the type employing a replaceable reciprocating impact member.

These and still further objects of the present invention will become apparent upon considering the following detailed description of the present invention.

SUMMARY OF THE INVENTION

It has now been discovered, surprisingly, that having certain further elastomeric type attenuation means present in the pneumatic powered impact tool previously disclosed in said Ser. No. 08/498,370 application will produce unexpected reduction in vibration attributable to a novel joint and simultaneous cooperation by the vibration reducing components. More particularly, it has now been discovered that certain elastomeric means when disposed at a specific location in said device further reduces both inertial and impact vibration during tool operation to an unexpected degree. Steady vibrations produced from inertial effects when the present tool construction is simply hand-held without contacting the workpiece are thereby reduced to an almost insignificant degree as are the short duration but ordinarily much higher level vibrations produced upon physical impact of the work member with the workpiece. In general, the construction of a pneumatic powered impact tool operating in such improved manner includes a housing member having a central passageway, a closed end hollow sleeve member slidably engaged in the central passageway of said housing member which includes a free piston member movable disposed therein, a reciprocating impact member closing the front end of said sleeve member for cyclical engagement with said free piston member, vibration isolating means interposed between the front end of said sleeve member and said reciprocating impact member, said vibration isolating means having a laminar configuration formed with a first outer layer of solid elastomeric material, a rigid inner layer and a second outer layer of solid elastomeric material, a pair of oppositely biased mechanical spring means engaged by said sleeve member so as to be alternately compressed when the sleeve member moves, a pneumatic valve member closing the back end of said sleeve member for exerting pressurized fluid against opposite ends of said free piston member, the back end of the central passageway in said housing member forming a pneumatic vibration dampening chamber which is compressed by rearward movement of said sleeve member and resilient seal means disposed at the back end of said sleeve member for cooperative association with said vibration dampening chamber means. A suitable construction for the multi-part vibration isolating means in the present device can be found in the aforementioned U.S. Pat. No. 5,407,018. As therein disclosed, said vibration attenuating means can be formed with dual outer layers of the same or dissimilar elastomeric material while having a rigid inner layer, such as steel, physically sandwiched therebetween. Having such vibration isolating means in the present device absorbs internal vibration from being transferred to the outer housing member. Correspondingly, suitable construction of the cooperating mechanical spring means and pneumatic vibration dampening chamber provided in the present device can be found disclosed in the co-pending Ser. No. 08/498,370 application, previously incorporated herein by reference. A satisfactory structural configuration for said mechanical spring means can thereby comprise a pair of helically shaped metal coil members directly encircling the movable sleeve member intermediate its ends. Similarly, having the resilient seal means in the present device provided as an 0 ring member formed with elastomeric material, such as rubber, again enables such means to be directly affixed to the movable sleeve member.

DETAILED DESCRIPTION OF THE PREFERRED EMBODIMENTS

Figure 1:
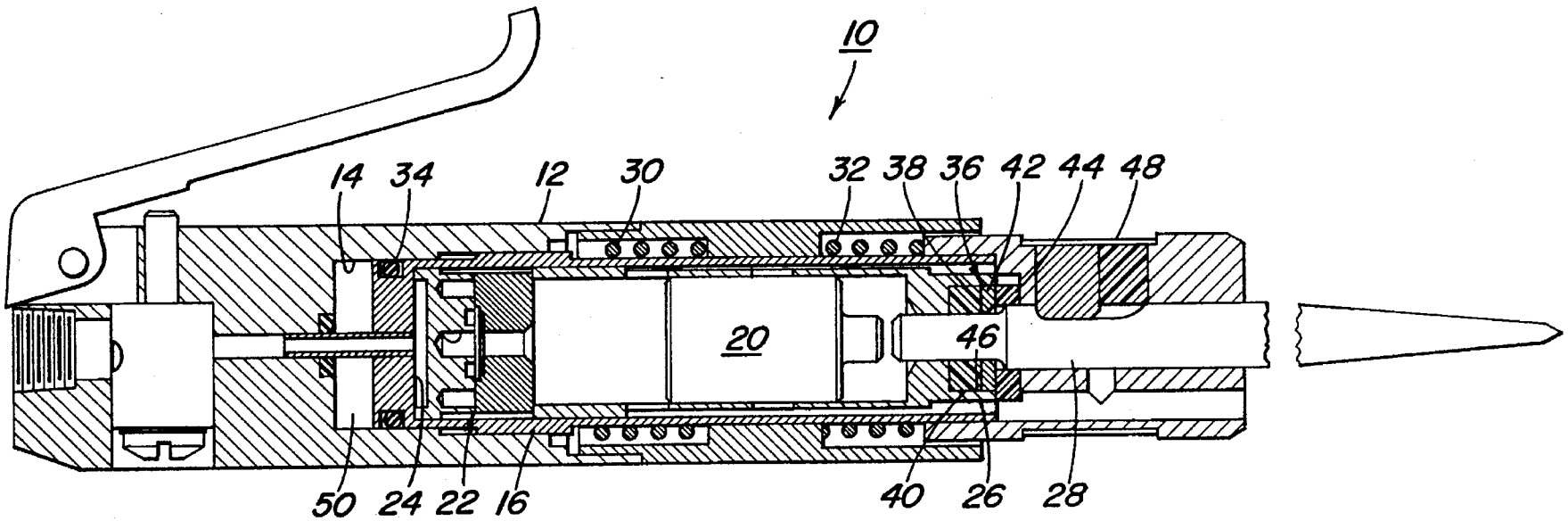
FIG. 1 is a side view partially in cross section for a representative hand-held pneumatic power tool according to the present invention.

Referring to the drawings, there is shown in FIG. 1 a side view partially in cross section for a representative hand-held pneumatic power tool 10 incorporating the presently improved vibration and noise attenuation means. As can be noted, the depicted tool construction is now commonly employed to remove weld flux scale in the metal industry and lacks handle means with the tool operator holding this device with a grip placed around the outer circumference of the tool housing 12. It is to be particularly further noted and understood, however, that the depicted hand-held tool represents but one kind of pneumatic powered impact tool device which can be advantageously operated with the present combination of attenuation means hereinafter further described. The depicted outer housing 12 is of a hollow cylindrical construction having a central passageway 14 which incorporates a closed end hollow sleeve member 16 slidably engaged for reciprocal movement within the central passageway. A free piston cylinder 20 is also slidably engaged for reciprocal movement within hollow sleeve member 16 when actuated by a conventional pneumatic valve mechanism 22 closing the back end 24 of said sleeve member. The front end 26 of sleeve member 16 is closed with a reciprocating impact member 28, such as a chisel and the like, for cyclical engagement with the front end 26 of free piston cylinder 20. Pneumatic valve mechanism 22 supplies a pressurized gaseous discharge medium, such as air, to drive the free piston member forward and back in cooperation with cyclical movement caused by collision between the moving piston and impact member. Understandably, such collisions occur repeatedly when the forward moving piston contacts the impact member as well as when the piston is caused to move backward when disturbed by action of the recoiling impact member. A pair of oppositely biased mechanical spring means 30 and 32 also physically engage sleeve member 16 so as to be alternately compressed with sleeve movement and in doing so serve as a means reducing vibration transfer to the tool housing 12. Suitable spring means for this purpose include helically shaped metal coil members and the like.

The hollow back end 50 of central passageway 14 forms a pneumatic vibration dampening chamber when compressed by rearward movement of sleeve member 16. The dampening effect produced by such means effectively counteracts vibration caused when reciprocating impact member 28 encounters a workpiece thereby enabling vibrational effects to be absorbed within the tool device itself. Additional vibration dampening is achieved in the present device construction with incorporation of resilient seal means 34 which are physically disposed in the customary manner at the back end of sleeve member 16. Conventional O-ring members formed with suitable elastomeric material and physically secured to said sleeve member thereby cooperate with sleeve movement in providing the desired vibration and noise attenuation.

Multi-part vibration isolating means 36 are further interposed between the front end 26 of said sleeve member 16 and said reciprocating impact member 28. As can be seen, said attenuation means 36 has a laminar disc-like configuration 38 formed with a first outer layer 40 of solid elastomeric material, such as rubber or polyurethane, a rigid metal inner layer 42, such as steel, and a second outer layer 44 of elastomeric material which can have the same or dissimilar material composition as the material composition employed in the first outer layer. A circular grooved depression 46 has been provided in the front end nose of sleeve member 16 to simply hold elements 40 and 42 of the employed attenuation means in place during tool assembly and operation since no further bonding together of component parts in said attenuation means is required. A further included retainer means 48 enables replacement or substitution of a different reciprocating impact member in the illustrated tool embodiment.

Figure 2:
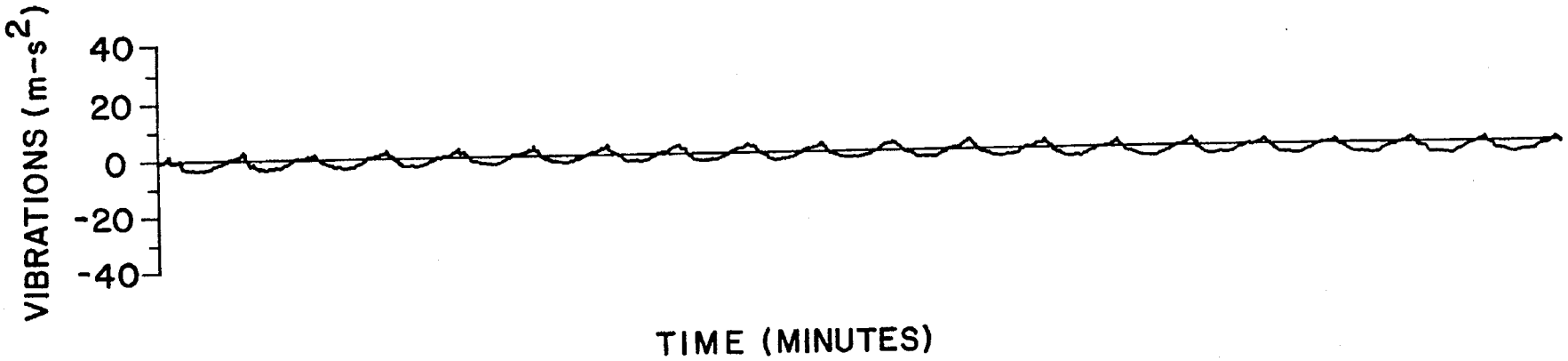
FIG. 2 is a graph for the reduced vibration experienced with the FIG. 1 tool construction.

FIG. 2 depicts the degree of reduced vibration experienced during operation of the FIG. 1 tool construction. Accordingly, said tool embodiment was mounted in a test stand enabling vibration measurement while being operated with conventional accelerometer sensing means. A further conventional dynamic signal analyzer instrument was employed to provide said vibration measurements in terms of conventional gravity (G) acceleration values (meters per second squared) perceived during the 400 minute time interval of tool operation as reported on the graph abscissa. As can be observed in the reported test results, there is far less vibration experienced during operation of the present tool construction. The peak vibrations reported in FIG. 4 of the previously cited U.S. Pat. No. 5,407,018 for a prior art tool construction lacking vibration attenuation means of any kind have now been entirely eliminated in the present tool construction. Moreover, a uniformly lower range of vibration is experienced in the present tool construction to further demonstrate attenuation of both impact and steady state inertial vibrations when being operated. Such overall improvement can be attributed to complex and simultaneous co-action of the vibration reducing components in the present tool construction. The dampening chamber means now being provided is believed to cooperate with the further provided resilient seal means in preventing excessive motion of the outer tool casing upon experiencing vibration produced within the tool itself. The contribution being provided with the cooperating mechanical spring means in the present tool construction is believed to be primarily a significant reduction in steady state inertial vibration occurring during tool operation. The still further provided front end elastomeric vibration isolation means provided in the present tool construction is believed to cooperate in absorbing short duration vibration produced by physical impact of the reciprocating work member with the tool body.

It will be apparent from the foregoing description that a broadly useful and novel means has been provided enabling a variety of pneumatic powered impact tools to be operated in a superior manner. It is contemplated that modification can be made in the specific construction of the employed attenuation means, including materials of construction as well as methods for construction other than herein specifically illustrated, however, without departing from the spirit and scope of the present invention. Similarly, it is contemplated that the front end elastomeric isolation means being employed in the present tool construction can have additional surface or intervening laminar elements provided to improve operating characteristics of the resulting multi-part assembly. Accordingly, it is intended to limit the present invention only by the scope of the appended claims.

What we claim as new and desire to secure by Letters Patent of the United States is:

1. A pneumatic powered impact tool having improved vibration attenuation which comprises:

(a) a housing member having a central passageway with front and back ends, (b) a closed end hollow sleeve member having front and back ends which is slidably engaged in the central passageway of said housing member and which includes a free piston member movably disposed therein with respect to both sleeve and housing members, (c) a reciprocating impact member closing the front end of said sleeve member for cyclical engagement with said free piston member, (d) vibration isolating means interposed between the front end of said sleeve member and said reciprocating impact member, said vibration isolating means having a laminar configuration formed with a first outer layer of solid elastomeric material, a rigid inner layer and a second outer layer of solid elastomeric material, (e) a pair of oppositely biased mechanical spring means disposed intermediate the ends of said sleeve member for engagement therewith so as to be alternately compressed when the sleeve member moves, (f) a pneumatic valve mechanism closing the back end of said sleeve member for axially exerting pressurized fluid against opposite ends of said free piston member, (g) the back end of the central passageway in said housing member forming a pneumatic vibration dampening chamber devoid of mechanical spring means and with a volume which is compressed by rearward movement of said sleeve member, and (h) resilient seal means disposed at the back end of said sleeve member for cooperative association with said vibration dampening chamber.

2. The impact tool of claim 1 wherein the resilient seal means is formed with an elastomeric material.

3. The impact tool of claim 1 wherein the resilient seal means is an O-ring member.

4. The impact tool of claim 1 wherein the reciprocating impact member is a chipping tool.

5. The impact tool of claim 4 wherein the chipping tool is physically secured to the sleeve member with retainer means enabling replacement.

6. The impact tool of claim 1 wherein each mechanical spring means comprises a helically shaped metal coil member.

7. The impact tool of claim 6 wherein each coil member is directly affixed to said sleeve member.

8. The impact tool of claim 1 wherein both elastomeric outer layers of the vibration isolating means interposed between the front end of said sleeve member and said reciprocating impact member have the same material composition.

9. The impact tool of claim 1 wherein both elastomeric outer layers of the vibration isolating means interposed between the front end of said sleeve member and said reciprocating impact member have different material compositions.

10. The impact tool of claim 1 wherein the rigid inner/layer of the vibration isolating means interposed between the front end of said sleeve member and said reciprocating impact member is metal.

11. A hand-held pneumatic powered chipping tool having improved vibration attenuation which comprises:

(a) a cylindrical housing having a cylindrical central passageway with front and back ends, (b) a closed end hollow cylindrical sleeve member having front and back ends which is slidably engaged in the central passageway of said housing and which includes a free piston cylinder movably disposed therein, (c) a replaceable reciprocating chisel member closing the front end of said sleeve member for cyclical engagement with said free piston cylinder and detachably secured thereto with retainer means, (d) vibration isolating means interposed between the front end of said sleeve member and said reciprocating chisel member, said vibration isolating means having a laminar configuration formed with a first outer layer of solid elastomeric material, a rigid inner layer and a second outer layer of solid elastomeric material, (e) a pair of oppositely biased h elically shaped metal spring coils disposed intermediate the ends of said sleeve member for engagement therewith so as to be alternately compressed when the sleeve member moves, (f) a pneumatic valve mechanism closing the back end of said sleeve member which supplies pressurized air axially to drive the piston cylinder forward and back cyclically within said sleeve member, (g) the back end of the central passageway in said housing forming a pneumatic vibration dampening cylindrical chamber devoid of mechanical spring means and with a volume which is compressed by rearward movement of said sleeve member, and (h) elastomeric material means having an O-ring configuration which are affixed to the back end of said sleeve member for cooperative association with said vibration dampening cylindrical chamber [means].

12. The chipping tool of claim 11 wherein both elastomeric outer layers of the vibration isolating means interposed between the front end of the sleeve member and said chisel member have the same material composition.

13. The chipping tool of claim 11 wherein both elastomeric outer layers of the vibration isolating means interposed between the front end of the sleeve member and said chisel member have different material compositions.

14. The chipping tool of claim 11 wherein the elastomeric outer layers of the vibration isolating means interposed between the front end of the sleeve member and said chisel member include a synthetic polyurethane material composition.

15. The chipping tool of claim 11 wherein the rigid inner/layer of the vibration isolating means interposed between the front end of said sleeve member and said chisel member is steel.

* * * * *